US005086551A

United States Patent [19]

Shamaly et al.

[11] Patent Number: 5,086,551

[45] Date of Patent: Feb. 11, 1992

[54] RIVET SETTING TOOL

[75] Inventors: Thomas P. Shamaly, Shelton; Sidney D. Schwartz, Hamden, both of Conn.

[73] Assignee: Emhart Inc., Towson, Md.

[21] Appl. No.: 577,956

[22] Filed: Sep. 5, 1990

[51] Int. Cl.[5] ..... B21J 15/20

[52] U.S. Cl. ..... 29/243.523; 29/243.525; 72/453.17

[58] Field of Search ..... 29/243.523, 243.524, 29/243.525; 72/453.16, 453.17

[56] References Cited

U.S. PATENT DOCUMENTS 4,515,005 5/1985 Klein ..... 29/243.525
4,598,571 7/1986 Oefinger ..... 29/243.523
4,770,023 9/1988 Schwab ..... 29/243.523
4,887,450 12/1989 Gast et al. ..... 29/243.523
4,888,974 12/1989 Mandell ..... 29/243.523

FOREIGN PATENT DOCUMENTS 2025295 1/1980 United Kingdom ..... 29/243.523
2152421 1/1985 United Kingdom ..... 29/243.523

*Primary Examiner*—David Jones
*Attorney, Agent, or Firm*—Spencer T. Smith

[57] ABSTRACT

Line air is continuously supplied to the return side of the piston of the pulling head adaptor assembly to return the piston to the start position and this air is also selectively connected to drive the vacuum transducer which operates the mandrel collection system.

3 Claims, 3 Drawing Sheets

RIVET SETTING TOOL

The present invention relates to pneumatically operated rivet setting tools and more particularly to such tools which include a collector bottle which is maintained under a vacuum so that spent mandrels will be drawn into the bottle.

In such rivet setting tools, hydraulic fluid is pneumatically intensified to operate a piston/rod assembly which sets the rivet. The spent mandrel is pulled into the collector bottle and compression spring returns the piston/rod assembly to its start location. The nose housing has a substantial diameter to accommodate this compression spring and this reduces the accessibility of the tool. To increase accessibility nose extenders having a reduced diameter are conventionally utilized.

It is accordingly an object of the present invention to reduce the diameter of the nose housing to increase the accessibility of the tool.

The present invention achieves this objective and in so doing substantially reduces the weight of the tool and simplifies its design thereby making it easier to service and repair.

Other objects and advantages of the present invention will become apparent from the following portion of this specification and from the accompanying drawings which illustrate in accordance with the mandate of the patent statutes a presently preferred embodiment incorporating the principles of the invention.

REFERRING TO THE DRAWINGS

Figure 1:
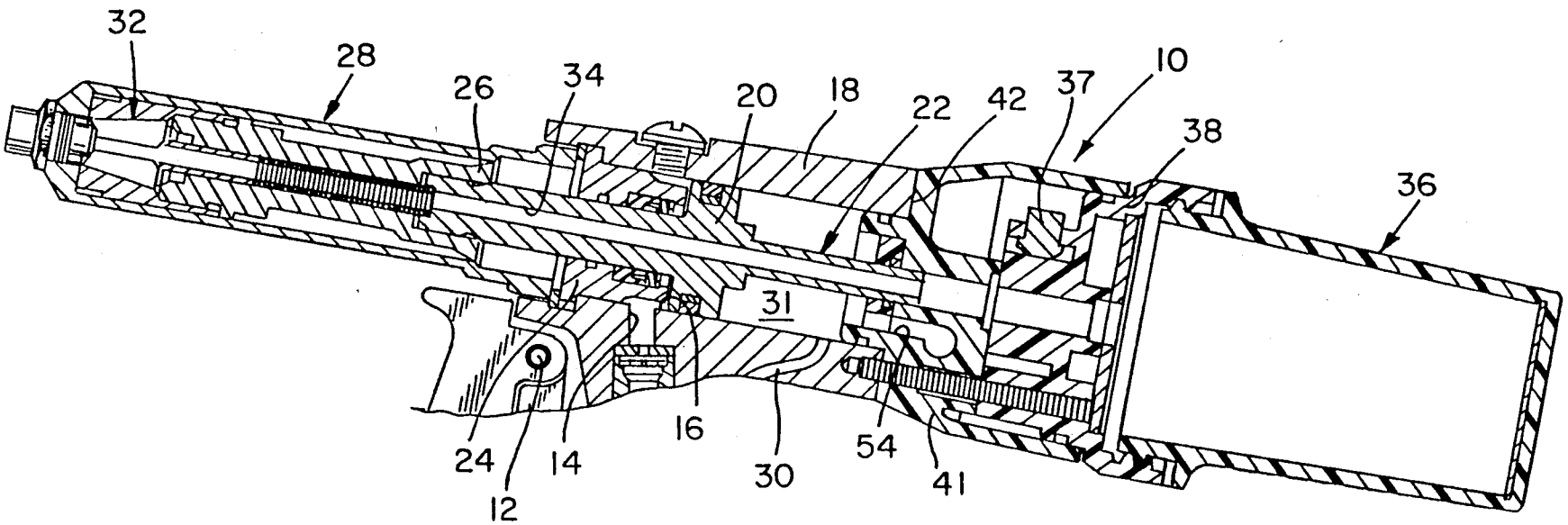
FIG. 1 is a side elevational view in cross section of a portion of a rivet setting tool made in accordance with the teachings of the present invention.

The rivet setting tool 10 is a pneumatically operated and hydraulically intensified. Depression of the trigger 12 results in fluid under high pressure being forced from the ram sleeve 14 into a substantially horizontal bore 16 in the handle 18 between the piston 20 of a piston/rod assembly 22 and a seal sleeve 24. This forcefully displaces the piston/rod assembly 22 to the right until the flanged end 26 of the pulling head adaptor 28 engages the left end of the seal sleeve 24. When the trigger 12 is released, this pressure is removed and line air pressure, continuously supplied via a conduit 30 in the handle to the retract volume 31 on other side of the piston 20, will return the piston/rod assembly to its start position.

The rivet tool continuously applies a vacuum to the tool nose 32 to hold the rivet and to draw a spent mandrel through a central bore 34 in the piston/rod assembly into a mandrel collector 36. The vacuum is generated by a vacuum transducer 37 housed within a vacuum cap body 38. This vacuum transducer receives line air from the retract volume 31 via an on/off valve 40 (FIG. 2) housed by a valve housing 41 which is located between the vacuum cap body 38 and the end 42 of the handle 18.

Figure 2:
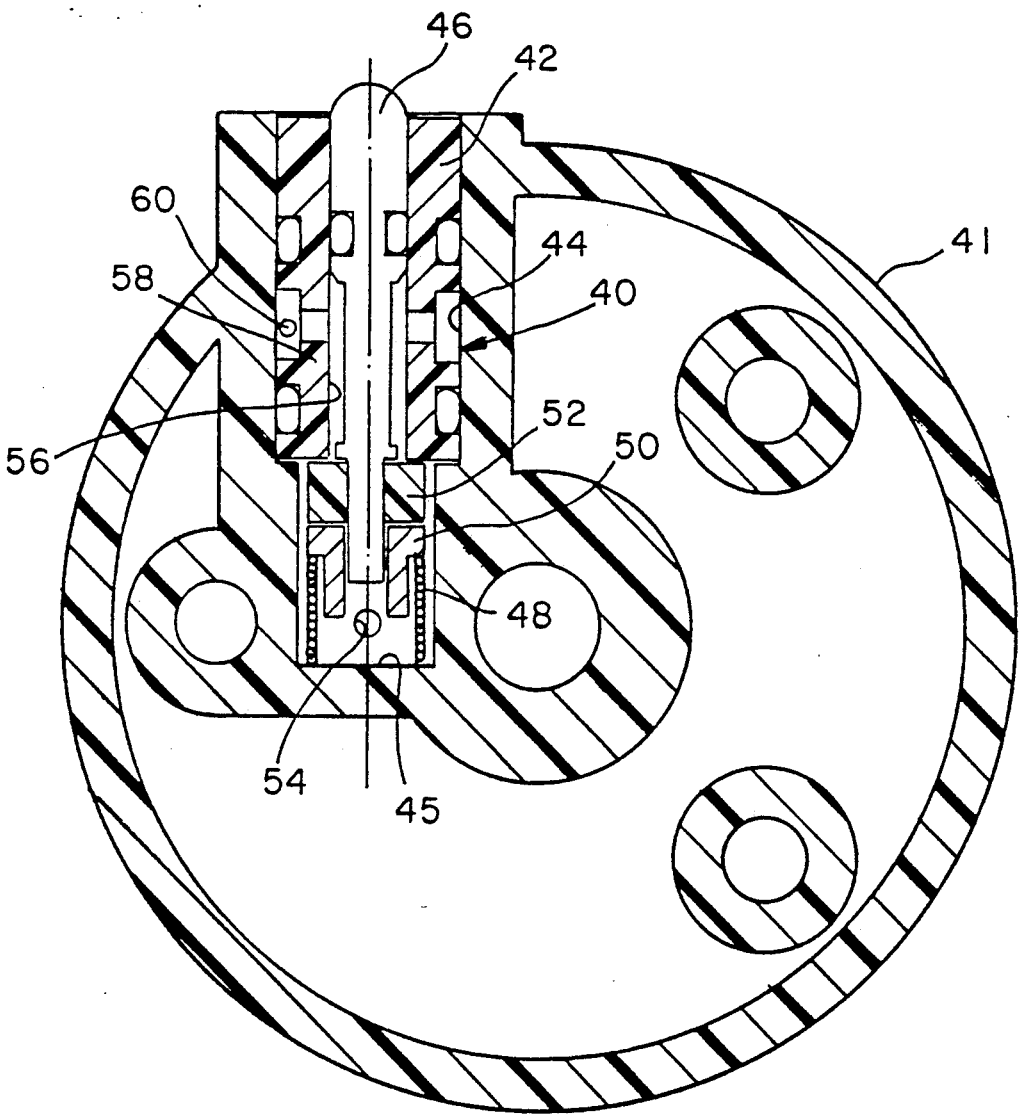
FIG. 2 is a cross sectional view, along the axis of the power train assembly, of the valve housing shown in FIG. 1.

Referring to FIG. 2, a valve body 42 is secured within a suitable bore 44 in the valve housing 41 and receives a valve stem 46. A spring 48 located between the end of the bore 44 and a valve guide 50 will push a valve seal 52 into sealing engagement with the valve body 42 preventing passage of line air from the retract chamber 31 through inlet conduit 54 and the reduced portion of the central bore into the central bore 56 of the valve body 42 through a valve body manifold 58 and out an exit port 60 which communicates, via conduits in the vacuum cap, with the vacuum transducer 37. When the valve stem 62 is pushed down, this line will be opened.

Figure 3:
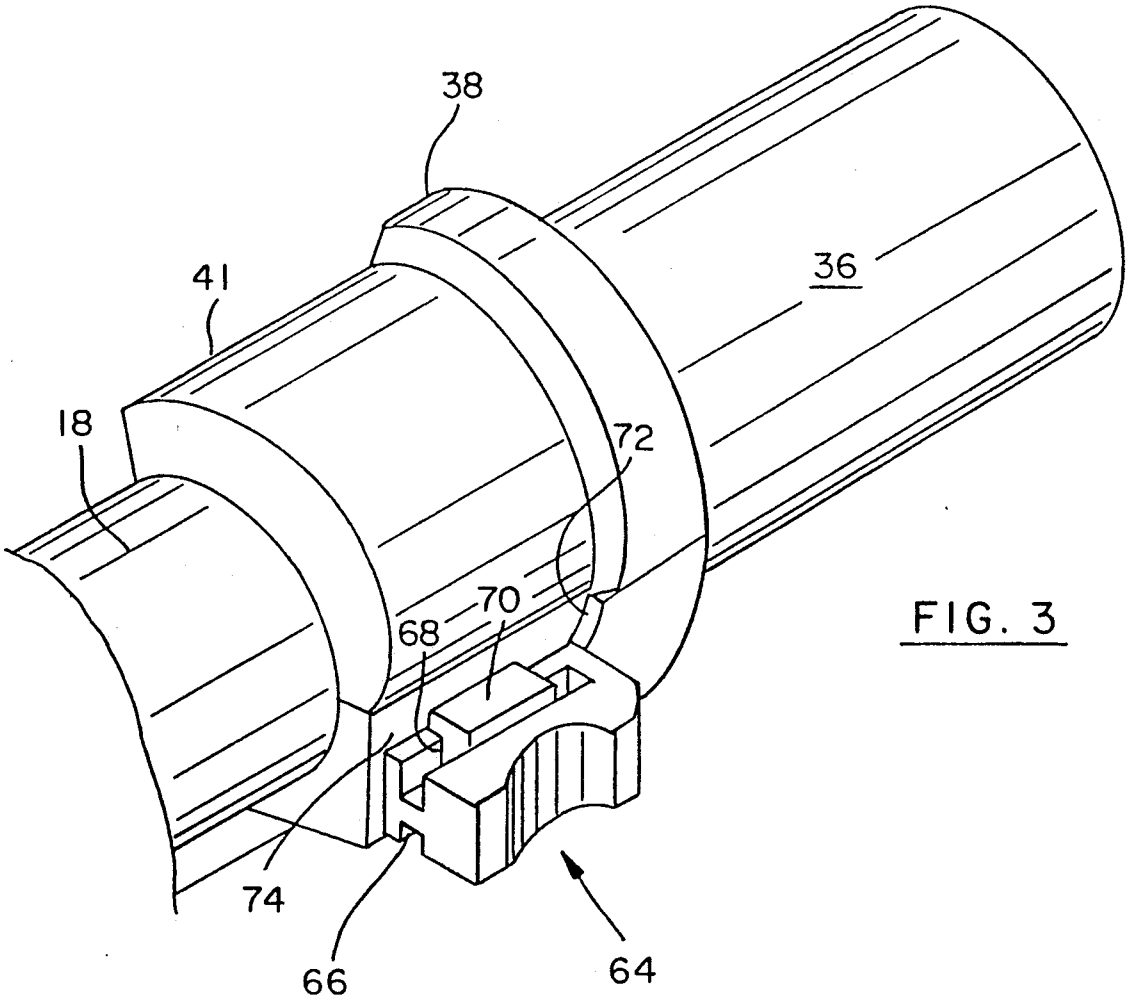
FIG. 3 is an oblique view of a portion of the tool illustrated in FIG. 1, showing the valve operating switch.

As can be seen from FIG. 3, the condition of this valve is controlled by a switch 64 which has outwardly extending rails 66 which are captured by internal grooves 68 in opposed capturing flanges 70. Removal of the switch is prevented by a stop 72 on the forward end of the vacuum cap body 38. When the switch is at the illustrated rearward position the bottom surface of the switch is flush with the vacuum housing surface 74 thereby depressing the valve stem 62. When the switch is moved forward into engagement with the rear of the capturing flanges 70, the valve stem 62 will be pushed up into a recess (not shown) thereby closing the valve and preventing line air from continuously exiting the tool through the vacuum transducer while the tool is hooked up to line air but not being used.

We claim:

1. A rivet setting tool comprising a pulling head adaptor assembly having a forward and rearward end including a tool nose at the forward end thereof and a piston at the rearward end thereof, said piston having a front and rear for receiving fluid pressure, housing means for supporting said assembly for displacement between start and finish locations, means for supplying liquid under pressure to the front of said piston to operate said assembly by displacing said piston from said start position to said finish position, means for supplying line air pressure to the rear of said piston for returning the piston to said start position, vacuum transducer means located in the rearward end of said pulling head adapter assembly and rearwardly of said piston including a vacuum transducer and a body for housing said vacuum transducer, and valve means located in the rearward end of said pulling head adapter assembly and rearwardly of said piston and intermediate said piston and said vacuum transducer including on/off valve means displaceable between an "on" position and an "off" position for selectively connecting the line air pressure at the rear of said piston to said vacuum transducer.

2. A rivet setting tool according to claim 1 wherein said line air pressure supplying means comprises means for supplying line air pressure continuously.

3. A rivet setting tool according to claim 1 further comprising mandrel collection means located at the rear of said vacuum transducer means.

* * * * *